US009829821B2

(12) United States Patent
Tsuda

(10) Patent No.: US 9,829,821 B2
(45) Date of Patent: Nov. 28, 2017

(54) IMAGE FORMING APPARATUS WITH PROTECTION FOR HEATING MEMBER

(71) Applicant: FUJI XEROX Co., Ltd., Tokyo (JP)

(72) Inventor: Yu Tsuda, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/018,226

(22) Filed: Feb. 8, 2016

(65) Prior Publication Data

US 2017/0045848 A1 Feb. 16, 2017

(30) Foreign Application Priority Data

Aug. 13, 2015 (JP) ..... 2015-159840

(51) Int. Cl.

*G03G 15/20* (2006.01)
*G03G 15/01* (2006.01)
*G03G 15/00* (2006.01)

(52) U.S. Cl.

CPC ..... *G03G 15/0126* (2013.01); *G03G 15/205* (2013.01); *G03G 15/6585* (2013.01); *G03G 15/0105* (2013.01); *G03G 15/0189* (2013.01)

(58) Field of Classification Search

CPC ..... G03G 15/2053; G03G 15/0105; G03G 15/6585

See application file for complete search history.

(56) References Cited

U.S. PATENT DOCUMENTS

2009/0220880 A1* 9/2009 Moffat ..... C09C 1/0015 430/108.6
2010/0196023 A1* 8/2010 Shiozawa ..... G03G 15/5029 399/39
2011/0103811 A1* 5/2011 Tamaki ..... G03G 15/04018 399/40
2012/0114362 A1* 5/2012 Tombs ..... G03G 15/5029 399/82
2013/0222846 A1* 8/2013 Okumura ..... G06F 3/1208 358/1.15
2014/0356035 A1 12/2014 Harashima et al.
2016/0378009 A1* 12/2016 Nakai ..... G03G 15/0131 399/223

FOREIGN PATENT DOCUMENTS

JP 2006-317632 A 11/2006
JP 2012027076 A * 2/2012
JP 2014-235381 A 12/2014

* cited by examiner

*Primary Examiner* — David M Gray
*Assistant Examiner* — Laura Roth
(74) *Attorney, Agent, or Firm* — Sughrue Mion, PLLC

(57) ABSTRACT

An image forming apparatus includes a first image forming unit that forms a transparent toner image by using a transparent toner, a second image forming unit that forms a metal-colored toner image by using a metal-colored toner containing a flat metallic pigment, and a fixing device that fixes a toner image to a recording medium as a result of a heating member contacting and heating the toner image. The image forming apparatus has a mode in which the transparent toner image is superimposed upon the metal-colored toner image, and the toner images are fixed by the fixing device.

21 Claims, 10 Drawing Sheets

IMAGE FORMING APPARATUS WITH PROTECTION FOR HEATING MEMBER

CROSS-REFERENCE TO RELATED APPLICATIONS

This application is based on and claims priority under 35 USC 119 from Japanese Patent Application No. 2015-159840 filed Aug. 13, 2015.

BACKGROUND

Technical Field

The present invention relates to an image forming apparatus.

SUMMARY

According to an aspect of the invention, there is provided an image forming apparatus including a first image forming unit that forms a transparent toner image by using a transparent toner, a second image forming unit that forms a metal-colored toner image by using a metal-colored toner containing a flat metallic pigment, and a fixing device that fixes a toner image to a recording medium as a result of a heating member contacting and heating the toner image. The image forming apparatus has a mode in which the transparent toner image is superimposed upon the metal-colored toner image, and the toner images are fixed by the fixing device.

BRIEF DESCRIPTION OF THE DRAWINGS

An exemplary embodiment of the present invention will be described in detail based on the following figures, wherein.

DETAILED DESCRIPTION

An image forming apparatus according to an exemplary embodiment of the present invention is described. In the figures, a double-headed arrow H indicates vertical directions, and a double-headed arrow W indicates horizontal directions, which are width directions of the apparatus.

Structure of Image Forming Apparatus

Figure 1:
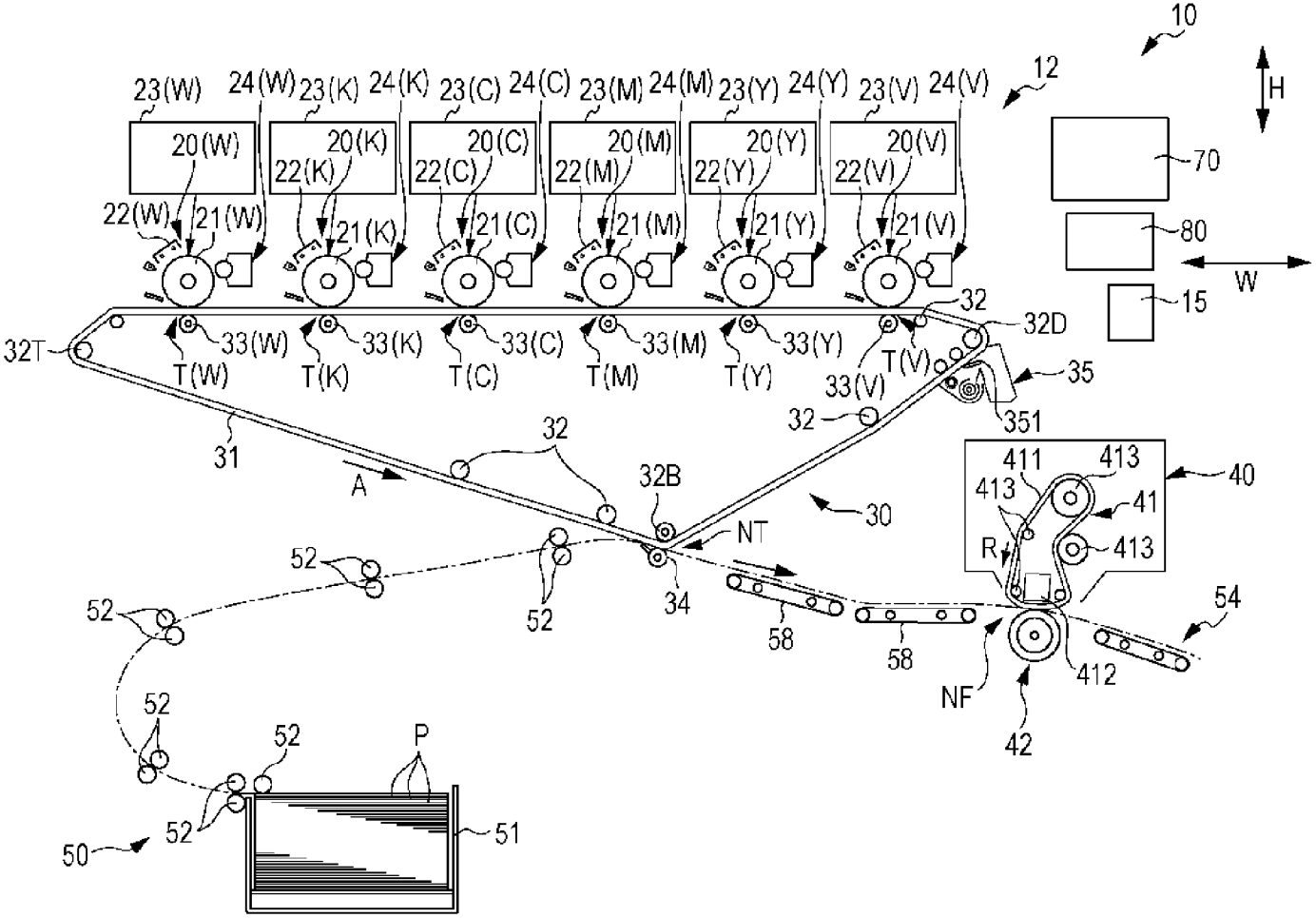
FIG. 1 is a schematic view of the structure of an image forming apparatus according to an exemplary embodiment of the present invention.

FIG. 1 is a schematic view of the structure of an image forming apparatus 10 when seen from the front. As shown in FIG. 1, the image forming apparatus 10 includes an image forming device 12, a transporting device 50, a controller 70, and a power supply device 80. The image forming device 12 forms an image on a sheet surface PA (see, for example, FIGS. 5A and 5B, and FIG. 6) of a sheet-like recording medium (sheet member) P, such as paper, by an electrophotographic system. The transporting device 50 transports the recording medium P. The controller 70 controls the operation of each portion of the image forming apparatus 10. The power supply device 80 supplies electric power to each structural element. An operating device 15 that is used by a user to perform various operations is provided in the image forming apparatus 10.

Transporting Device

As shown in FIG. 1, the transporting device 50 includes an accommodation unit 51 that accommodates recording media P, and multiple transport rollers 52 that transport the recording media P from the accommodation unit 51 to a second transfer position NT (described later). The transporting device 50 further includes multiple transport belts 58 that transport the recording media P from the second transfer position NT to a fixing device 40, and a transport belt 54 that transports the recording media P from the fixing device 40 to a discharge unit (not shown) on which the recording media P are discharged.

Image Forming Device

The image forming device 12 includes toner image forming units 20 that form toner images, a transfer device 30 that transfers the toner images formed by the toner image forming units 20 to a recording medium P, and the fixing device 40 that heats and presses the toner images transferred to the recording medium P, and fixes the toner images to the recording medium P.

The toner image forming units 20 are provided for forming the toner images for corresponding colors, respectively. In the exemplary embodiment, image forming units 20V, 20W, 20Y, 20M, 20C, and 20K for six colors, that is, a first special color (V), a second special color (W), yellow (Y), magenta (M), cyan (C), and black (K), are provided. The symbols (V), (W), (Y), (M), (C), and (K) in FIG. 1 indicate the corresponding colors mentioned above.

Figure 2:
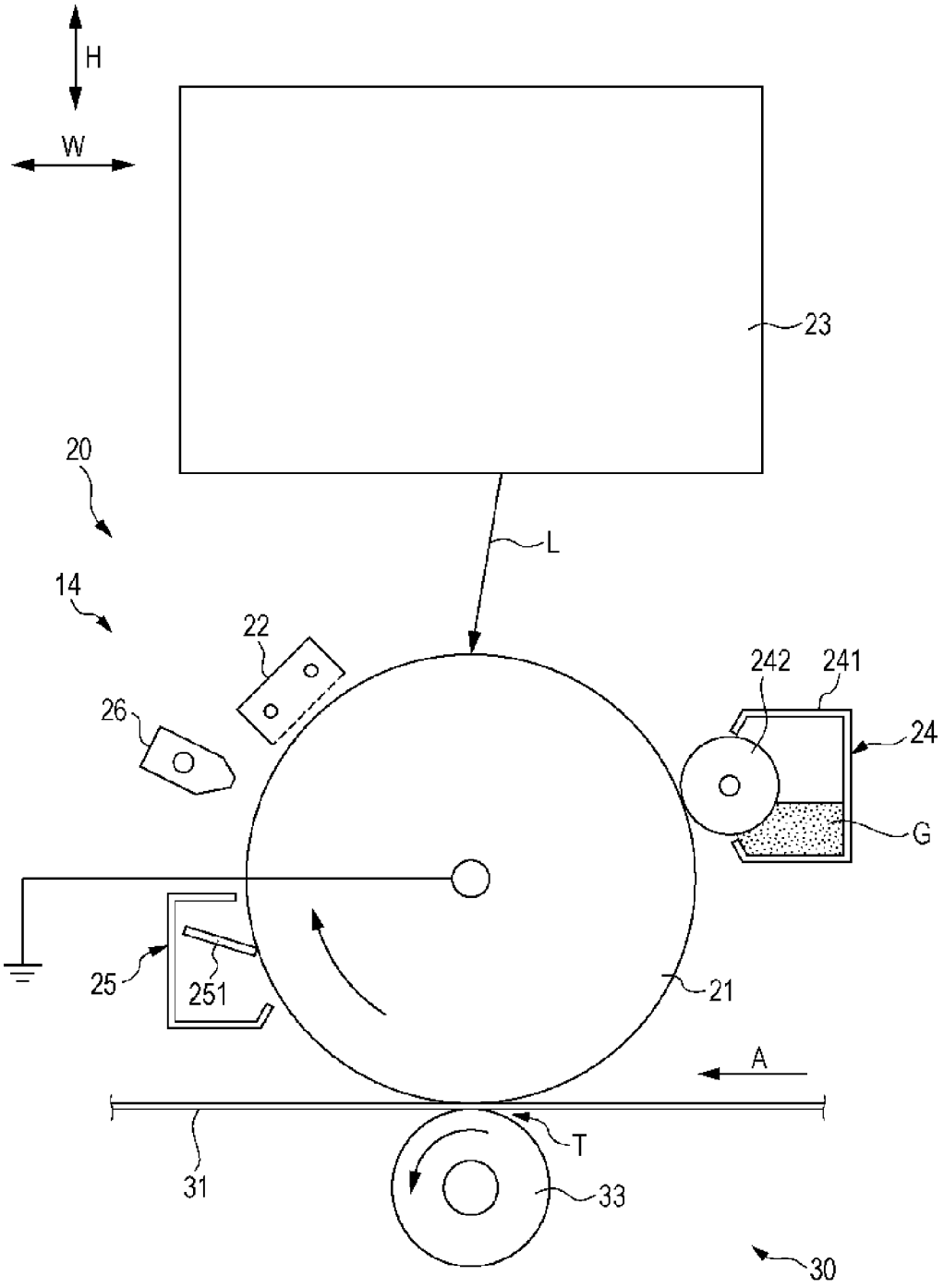
FIG. 2 illustrates the structure of a toner image forming unit of the image forming apparatus according to the exemplary embodiment of the present invention.

In the exemplary embodiment, the first special color (V) is transparent, and the second special color (W) is gold that is used for a metal-colored toner (gold toner as described below in the exemplary embodiment) containing flat metallic pigments. In FIG. 2, only one toner image forming unit is shown as a representative image forming unit, that is, without distinguishing the toner image forming units 20 by using alphabetic characters.

The toner image forming unit 20V that is used as an exemplary first image forming unit and that is provided for the first special color (V) is disposed at the uppermost stream side in a direction of rotation of an intermediate transfer belt 31. The toner image forming unit 20W that is used as an exemplary second image forming unit and that is provided for the second special color (W) is disposed at the lowermost stream side in the direction of rotation of the intermediate transfer belt 31. In other words, the toner image forming unit 20V for the first special color (V) first-transfers a toner image to the intermediate transfer belt 31 first, and, the toner image forming unit 20W for the second special color first-transfers a toner image to the intermediate transfer belt 31 last.

Toner Image Forming Units

As shown in FIG. 1, the toner image forming units 20 for the corresponding colors basically have the same structure except that they use different toners. More specifically, referring to FIG. 2, each toner image forming unit 20 for its corresponding color includes a photoconductor drum 21 that rotates clockwise in FIG. 2 and a charging unit 22 that charges the corresponding photoconductor drum 21. Each toner image forming unit 20 for its corresponding color further includes an exposure device 23 that exposes the photoconductor drum 21 charged by the charging unit 22 to light to form an electrostatic latent image on the photoconductor drum 21, a developing device 24 that develops the electrostatic latent image formed on the photoconductor drum 21 by the exposure device 23 to form a toner image, a cleaning device 25, and a charge-removing device 26.

Developing Device

Referring to FIG. 2, each developing device 24 includes a container 241 that contains developer G and a developing roller 242. By applying development bias voltage to each developing roller 242, a potential difference that is provided between each developing roller 242 and the corresponding photoconductor drum 21 causes the electrostatic latent image formed on an outer peripheral surface of the corresponding photoconductor drum 21 to be developed as a toner image.

Cleaning Device

Each cleaning device 25 includes a scraping blade 251 that scrapes off from the surface of the corresponding photoconductor drum 21 any residual toner remaining on the surface of the corresponding photoconductor drum 21 after the transfer of the toner image by the transfer device 30.

Transfer Device

At the transfer device 30, the toner images on the photoconductor drums 21 for the corresponding colors are first-transferred to and superimposed upon each other on the intermediate transfer belt 31 (exemplary intermediate transfer body) at respective first transfer positions T, and the superimposed toner images are second-transferred to the recording medium P at the second transfer position NT. More specifically, the transfer device 30 includes the intermediate transfer belt 31, first transfer rollers 33, and a second transfer roller 34 serving as an exemplary transfer member.

Intermediate Transfer Belt

As shown in FIG. 1, the intermediate transfer belt 31 is an endless belt, and is wound upon multiple rollers 32. Of the rollers 32, the roller 32D functions as a driving roller that circulates the intermediate transfer belt 31 in the direction of arrow A by the power of a motor (not shown). By circulating the intermediate transfer belt 31 in the direction of arrow A, the toner images first-transferred and superimposed upon each other at the respective first transfer positions T are transported to the second transfer position NT.

Of the multiple rollers 32, the roller 321 functions as a tension applying roller that applies tension to the intermediate transfer belt 31. Of the multiple rollers 32, the roller 32B functions as an opposing roller that opposes the second transfer roller 34.

A cleaning device 35 that cleans the intermediate transfer belt 31 is disposed downstream from the second transfer position NT and upstream from each first transfer position T(V) in a circulation direction of the intermediate transfer belt 31 (direction of arrow A). The cleaning device 35 includes a scraping blade 351 that scrapes off any residual toner remaining on a surface of the intermediate transfer belt 31 from the surface of the intermediate transfer belt 31.

First Transfer Rollers

Each first transfer roller 33 is a roller that transfers the toner image on its corresponding photoconductor drum 21 to the intermediate transfer belt 31. The first transfer rollers 33 are disposed at an inner side of the intermediate transfer belt 31. The first transfer rollers 33 are disposed so as to oppose the photoconductor drums 21 for the corresponding colors with the intermediate transfer belt 31 being interposed therebetween. By applying a first transfer voltage having a polarity that is opposite to the polarity of the toner to each first transfer roller 33, the toner image formed on each photoconductor drum 21 is transferred to the intermediate transfer belt 31 at its corresponding first transfer position T.

Second Transfer Roller

The second transfer roller 34 is a roller that transfers the toner images superimposed upon the intermediate transfer belt 31 to a recording medium P. The second transfer roller 34 is disposed such that the intermediate transfer belt 31 is nipped between the second transfer roller 34 and the aforementioned opposing roller 32B. The second transfer roller 34 and the intermediate transfer belt 31 are in contact with each other with a predetermined load. The second transfer position NT is situated between the second transfer roller 34 and the intermediate transfer belt 31 that are in contact with each other in this way. The recording medium P is supplied at a proper time from the accommodation unit 51 to the second transfer position NT.

Fixing Device

Figure 3:
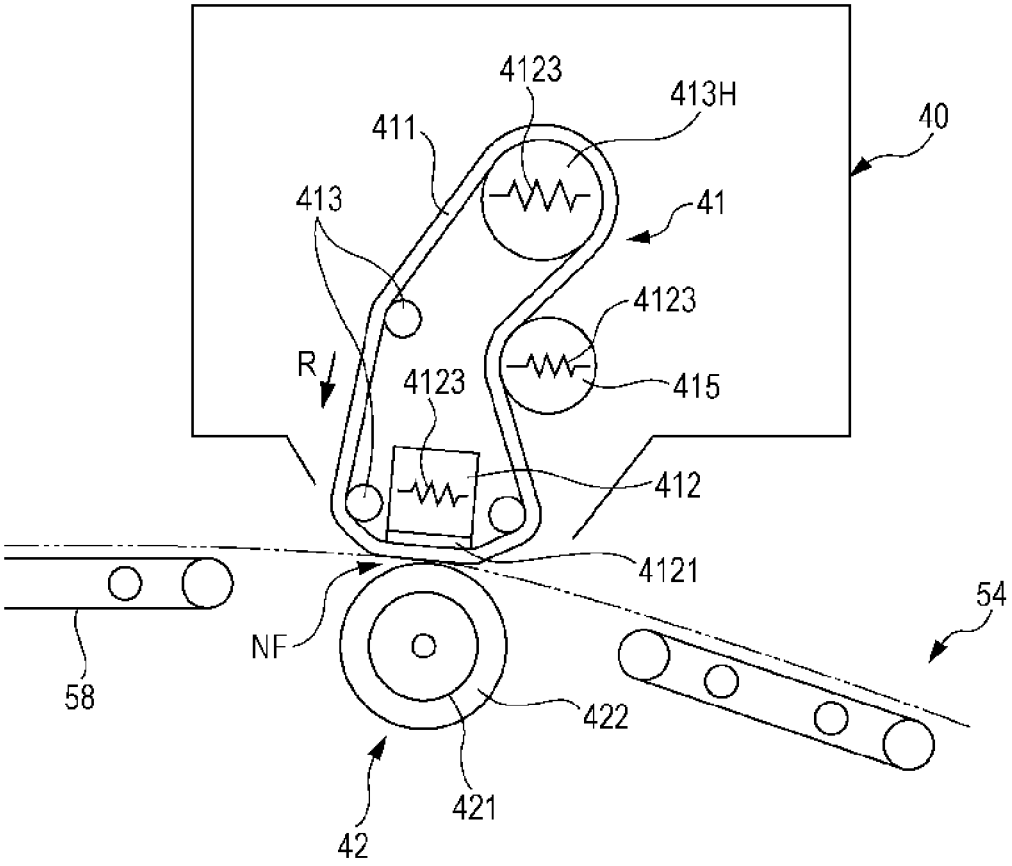
FIG. 3 illustrates the structure of a fixing device of the image forming apparatus according to the exemplary embodiment of the present invention.

As shown in FIG. 3, the fixing device 40 includes a fixing belt 411, which is an exemplary heating member, a pad member 412 whose longitudinal direction corresponds to a direction towards a far side of the device, and multiple rollers 413 whose direction towards the far side of the device is a rotation axis direction.

The fixing belt 411 is an annular (endless) belt having openings on two sides in the direction towards the far side of the device that is perpendicular to a transport direction of recording medium P. The fixing belt 411 is wound upon the pad member 412, the multiple rollers 413, and an external roller 415, and is set in a determined orientation. The fixing belt 411 circulates in the direction of arrow R with this orientation being maintained (that is, circulates along a circulation path that is defined by this orientation).

The fixing belt 411 according to the exemplary embodiment includes a fluororesin layer, whose principal component is polyimide, formed on a surface of the belt.

The pad member 412 is disposed at an inner side of the fixing belt 411. When a nip forming portion 4121 receives a push (nip) load from a pressing roller 42, a fixing nip NF is formed between the fixing belt 411 and the pressing roller 42. The pad member 412 is secured to a device frame (not shown), and does not follow the circulation of the fixing belt 411.

A halogen lamp 4123, which is an exemplary heating source, is provided in the pad member 412. Therefore, the pad member 412 also functions as a heat transferring member that transfers heat generated by the halogen lamp 4123 to the fixing belt 411 via the nip forming portion 4121.

Among the multiple rollers 413, the roller 413H that is positioned farthest from the pad member 412 functions as an internal heating roller that heats the fixing belt 411 from an inner peripheral side of the fixing belt 411. More specifically, the fixing belt 411 is wound upon the roller 413H from an inner peripheral side of the fixing belt 411, and heat generated by a halogen lamp 4123 that is provided in the roller 413H is transferred to the fixing belt 411.

The fixing device 40 includes the external roller 415 upon which the fixing belt 411 is wound from an outer peripheral side of the fixing belt 411. The external roller 415 functions as an external heating roller that heats the fixing belt 411 from the outer peripheral side of the fixing belt 411. More specifically, heat generated by a halogen lamp 4123 that is provided in the external roller 415 is transferred to the fixing belt 411. By rotating the external roller 45 by a driving source (not shown), the external roller 45 functions as a driving roller that applies driving force to the fixing belt 411 for circulating the fixing belt 411.

The pressing roller 42 includes a silicone rubber elastic layer 422 that covers an outer periphery of a circular cylindrical roller member 421 formed from aluminum. By rotating the pressing roller 42 by a driving source (not shown), the pressing roller 42 functions as a driving roller that applies driving force to the fixing belt 411 for circulating the fixing belt 411.

In the fixing device 40 having such a structure, by pressing the toner images on the recording medium P to which the toner images have been transferred while heating such toner images, the toner images are fixed to a recording medium P at the fixing nip NF formed by the fixing belt 411 and the pressing roller 42.

Image Forming Operation

Next, a general description of the steps for forming images on a recording medium P by the image forming apparatus 10 and steps for performing postprocessing operations is given.

As shown in FIG. 1, the controller 70 that has received an image formation instruction causes the toner image forming units 20, the transfer device 30, and the fixing device 40 to be operated. In synchronism with these operations, the controller 70 causes, for example, the transporting device 50 to be operated.

The photoconductor drums 21 for the corresponding colors are charged by the corresponding charging units 22 while the photoconductor drums 21 are rotated. The controller 70 sends image data subjected to image processing by an image signal processor to each exposure device 23. Each exposure device 23 emits exposure light L (refer to FIG. 2) that is in accordance with the image data to expose the corresponding charged photoconductor drum 21 to the exposure light L. This causes an electrostatic latent image to be formed on the outer peripheral surface of each photoconductor drum 21. The electrostatic latent images formed on the corresponding photoconductor drums 21 are developed by the corresponding developing devices 24, so that a toner image having the first special color (V), a toner image having the second special color (W), a yellow (Y) toner image, a magenta (M) toner image, a cyan (C) toner image, and a black (K) toner image are formed on the corresponding photoconductor drums 21 for the corresponding colors.

The toner images having the corresponding colors formed on the corresponding photoconductor drums 21 for the corresponding colors are successively first-transferred to the circulating intermediate transfer belt 31 by the corresponding first transfer rollers 33 for the corresponding colors at the respective first transfer positions T. This causes a superimposition toner image formed by superimposing the toner images of six colors to be formed on the intermediate transfer belt 31.

As mentioned above, the toner image forming unit 20V for the first special color (V) first-transfers a transparent toner image TVG (refer to FIG. 6) to the intermediate transfer belt 31 first, and the toner image forming unit 20W for the second special color (W) first-transfers a gold toner image TWG (refer to FIG. 6) to the intermediate transfer belt 31 last.

The superimposition toner image is transported to the second transfer position NT by the circulation of the intermediate transfer belt 31. In accordance with the timing of transport of the superimposition toner image, the transport rollers 52 supply the recording medium P to the second transfer position NT. The superimposition toner image is second-transferred to the recording medium P from the intermediate transfer belt 31 at the second transfer position NT.

The recording medium P to which the toner image has been second-transferred is transported towards the fixing device 40 by the transport belts 58 while performing negative suction on the recording medium P. The fixing device 40 applies heat and pressing force to the recording medium P that passes the fixing nip NF. This causes the toner image transferred to the recording medium P to be fixed to the recording medium P.

The recording medium P to which the toner image has been fixed by the fixing device 40 is transported and discharged to the discharge unit (not shown) by the transport belt 54.

Structure of Principal Portion

Next, the structure of a principal portion according to the exemplary embodiment is described.

Toner

Colored Toner

Figure 6:
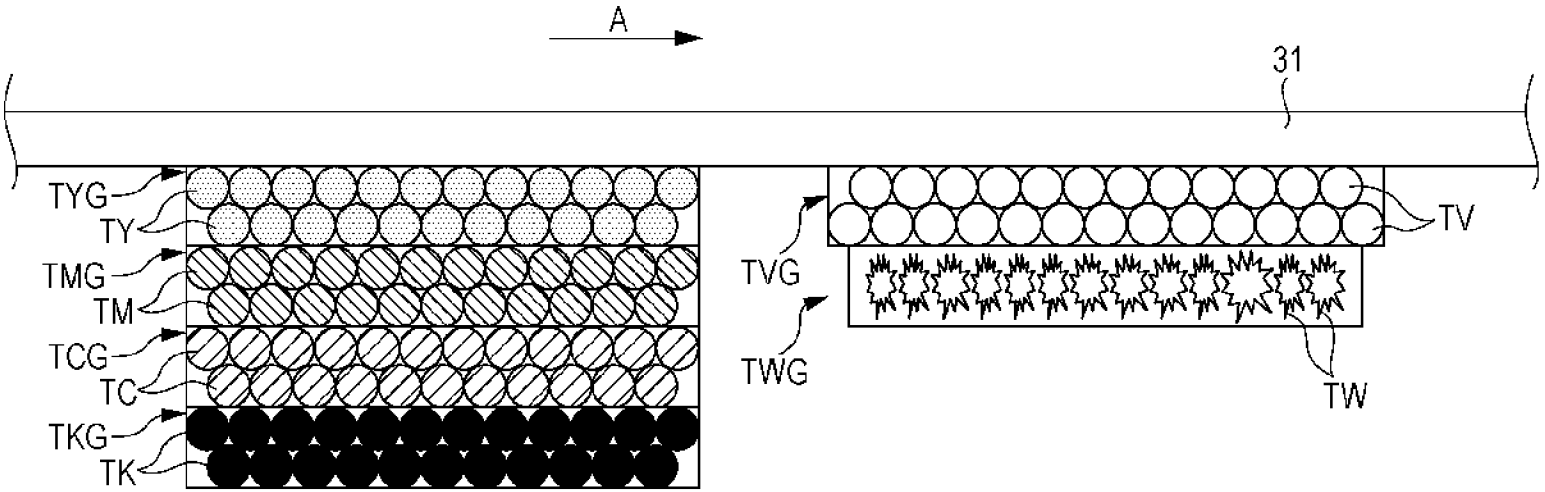
FIG. 6 is a schematic view of a state in which colored toner images are superimposed upon each other on an intermediate transfer belt.

As shown in FIG. 6, colored toners other than the toner having the first special color (V) and the toner having the second special color (W), that is, a yellow toner TY, a magenta toner TM, a cyan toner TC, and a black toner TK (such colored toners may hereunder be referred to as "colored toner TR") contain pigments not including flat metallic pigments (such as organic pigments and inorganic pigments), and binder resin.

Toner images that are formed from an unfixed yellow toner TY, an unfixed magenta toner TM, an unfixed cyan toner TC, and an unfixed black toner TK are called a yellow toner image TYG, a magenta toner image TMG, a cyan toner image TCG, and a black toner image TKG. The term "colored toner image TRG" may sometimes be used as a general term for these toner images.

Gold Toner (Metal-Colored Toner)

Figure 4A:
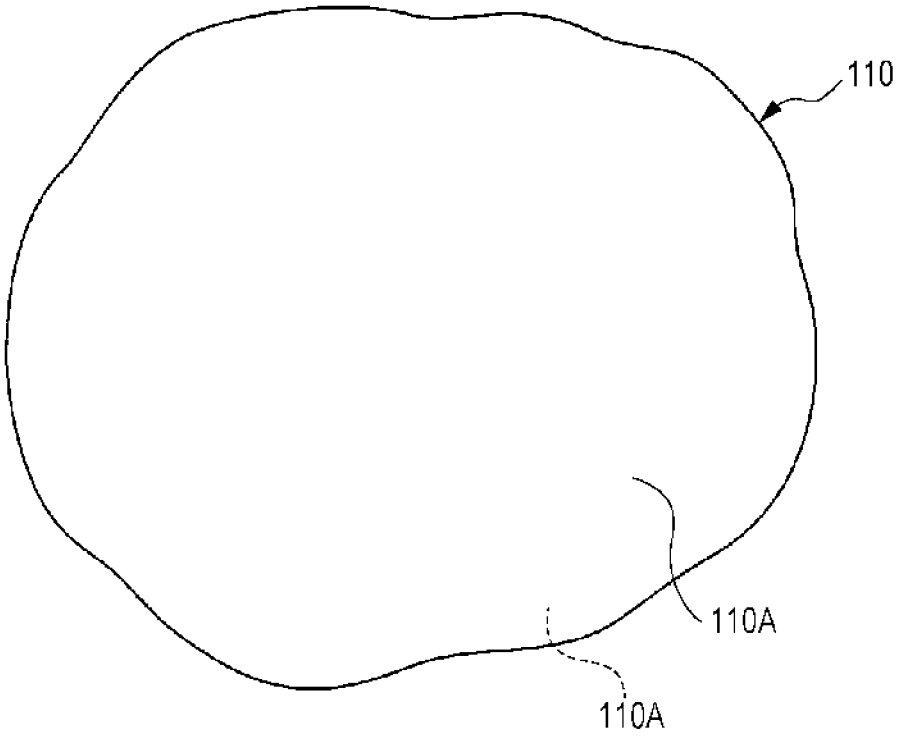
FIG. 4A is a plan view of a flat metallic pigment.
Figure 4B:
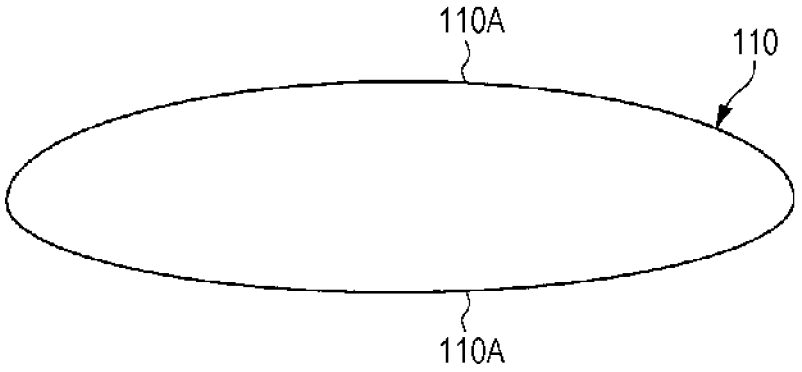
FIG. 4B is a side view of the metallic pigment.
Figure 5A:
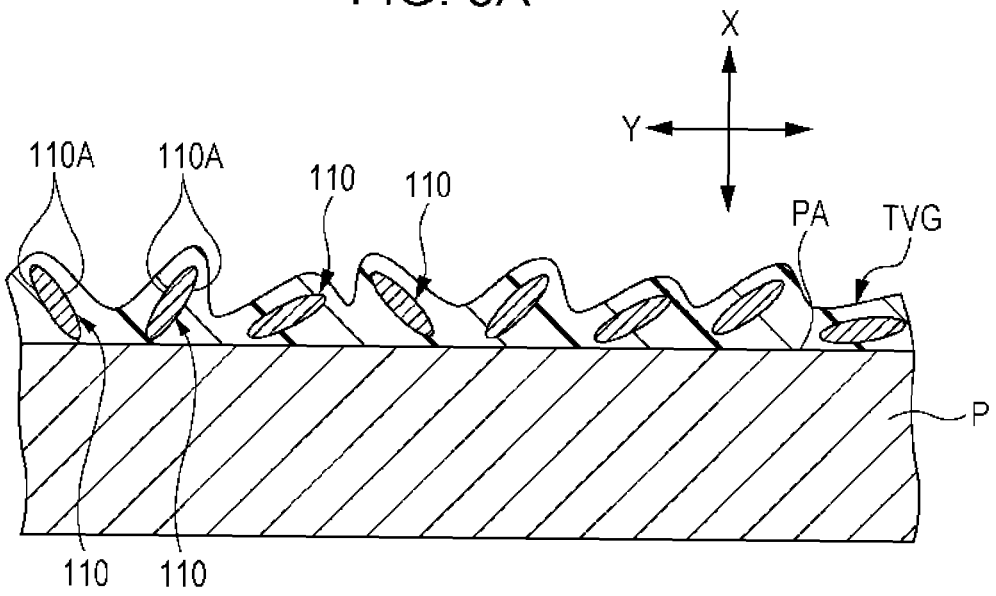
FIG. 5A is a sectional view of a gold toner image, schematically illustrating a state in which flat metallic pigments are not provided along a sheet surface of a sheet member.
Figure 5B:
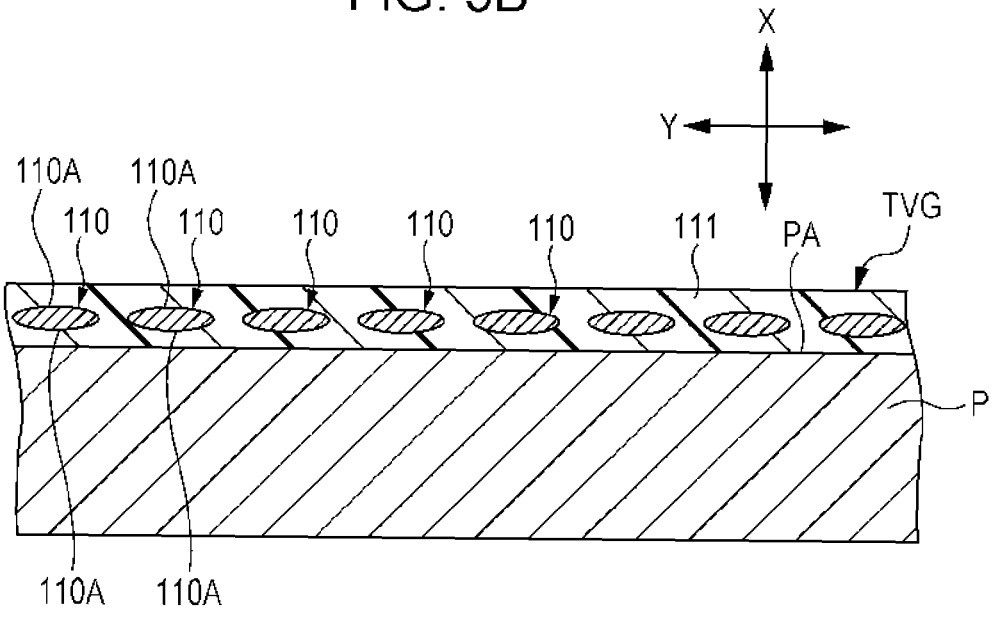
FIG. 5B is a sectional view of the gold toner image, schematically illustrating a state in which the metallic pigments are provided along the sheet surface of the sheet member.
Figure 7:
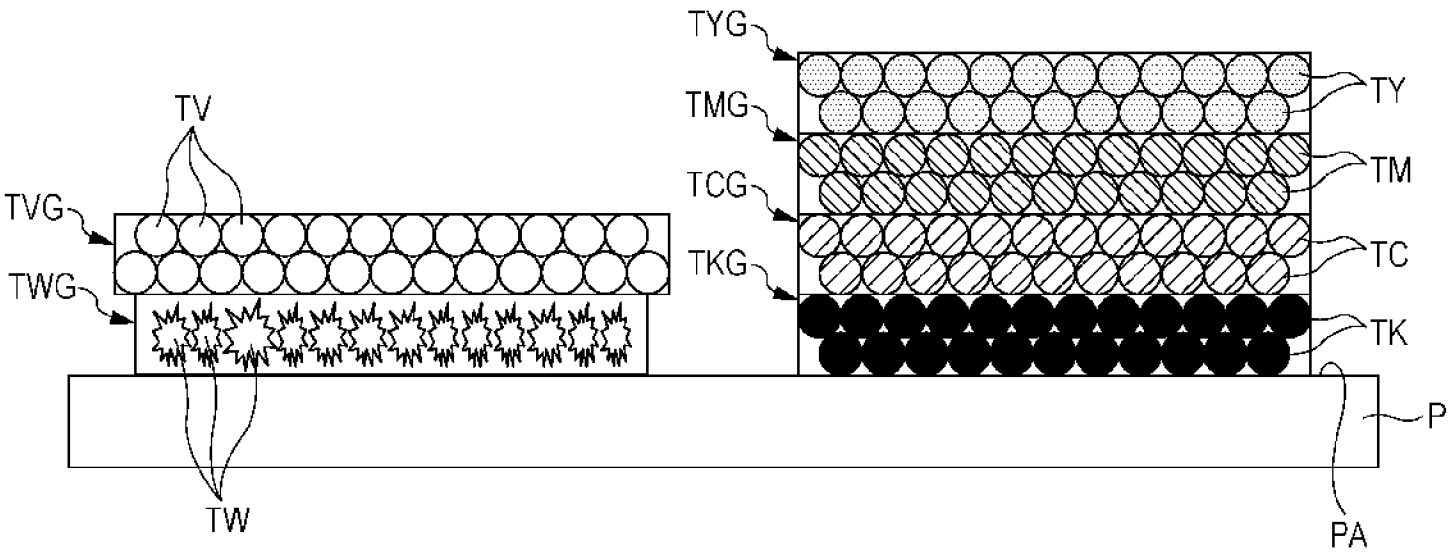
FIG. 7 is a schematic view of a state in which the colored toner images are superimposed upon each other on a recording medium prior to a fixing operation.

As shown in FIG. 7, the gold toner TW that uses the second special color (W) contains, as shown in FIG. 5B, flat metallic pigments 110 (also refer to FIG. 4), yellow (Y) pigment (not shown), and binder resin 111. The gold toner TW is used when an image is to be given metallic glossiness.

The image to be given metallic glossiness includes both an image that is formed from the gold toner TW and a colored toner other than the gold toner TW, and an image formed from the gold toner TW alone. An unfixed toner image formed from the gold toner TW is called the gold toner image TWG.

The flat metallic pigments 110 according to the exemplary embodiment contain aluminum as principal component. In addition, when the metallic pigments 110 in a plane are viewed from a side, referring to FIG. 4B, the metallic pigments 110 each have a shape whose dimension in a left-right direction in FIG. 4B is longer than its dimension in an up-down direction in FIG. 4B.

Further, when the flat metallic pigments 110 shown in FIG. 4B are viewed from thereabove in FIG. 4B, referring to FIG. 4A, the metallic pigments 110 each have a shape that is wider than when viewed from the side. The metallic pigments 110 each include a pair of opposing reflecting surfaces 110A (flat surfaces), which face upward and downward, respectively, when the metallic pigments 110 are in a plane (refer to FIG. 4B). In this way, the metallic pigments 110 are flat.

As shown in FIG. 5B, when, in the fixed gold toner TW, the reflecting surfaces 110A of the flat metallic pigments 110 face a direction that is perpendicular to a sheet plane PA and are disposed side by side in a direction along the sheet plane PA, that is, the reflecting surfaces 110A of the metallic pigments 110 are oriented so as to be disposed along the sheet plane PA of a recording medium P, light beams reflected from an image 100 converge in the same direction by a greater degree than when the reflecting surfaces 110A of the metallic pigments 110 shown in FIG. 5A do not face the same direction. This increases the flop index value (FI value), which is an index of metallic glossiness.

The flop index value (FI value) is a value that is measured in conformity with ASTM E2194, and is an index that indicates the metallic glossiness that is visually perceived by reflected light. The larger the flop index value, the higher the metallic glossiness.

Transparent Toner

A transparent toner TV that is used for the first special color (V) shown in FIG. 6 contains binder resin, and the transparent toner image TVG that is formed from the transparent toner TV has optical transparency (such as an optical transparency of 80% or greater) in the visible range.

Protection Mode

As shown in FIG. 7, the image forming apparatus 10 according to the exemplary embodiment has a protection mode in which, with the transparent toner image TVG being superimposed upon the gold toner image TWG on a recording medium P before a fixing operation, the fixing device 40 performs the fixing operation. The protection mode is selected by a user by operating the operating device 15.

The transparent toner image TVG is formed so as to cover the gold toner image TWG. That is, the area of the gold toner image TWG is smaller than the area of the transparent toner image TVG on the recording medium P before the fixing operation.

Here, as shown in FIG. 6, the transparent toner image TVG is provided on a lower side (intermediate-transfer-belt-31 side) of the gold toner image TWG on the intermediate transfer belt 31. By second-transferring the images to the recording medium P at the second transfer position NT, the transparent toner image TVG is in a state in which it is superimposed upon the gold toner image TWG.

Figure 8:
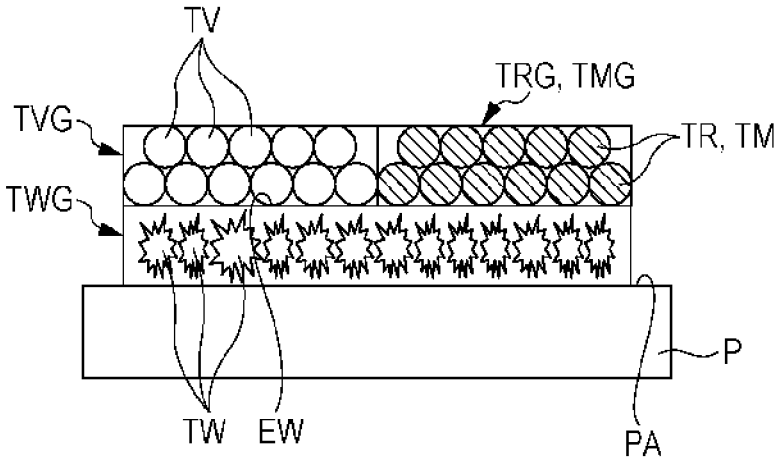
FIG. 8 is a schematic view of a state in which a transparent toner image is superimposed upon a region of the gold toner image upon which the colored toner image is not superimposed.

As shown in FIG. 8, when the colored toner image TRG is superimposed upon part of the gold toner image TWG, control is performed such that the transparent toner image TVG is superimposed upon a region EW of the gold toner image TWG upon which the colored toner image TRG is not superimposed.

Transparent Toner Image in Protection Mode

The dot area ratio (Cin) of the transparent toner image TVG that covers the gold toner image TWG in the protection mode has a lower limit. In the exemplary embodiment, the lower limit of the dot area ratio (Cin) of the transparent toner image TVG is 50%. In the exemplary embodiment, the dot area ratio (Cin) of the transparent toner image TVG is 100%.

Gold Toner Image in Protection Mode

An upper limit is set for the dot area ratio (Cin) of the gold toner image TWG upon which the transparent toner image TVG is superimposed in the protection mode. In the exemplary embodiment, the upper limit of the dot area ratio (Cin) of the gold toner image TWG is 60%. That is, even if, in terms of image data, the dot area ratio (Cin) of the gold toner image TWG is 100%, the image is formed with the dot area ratio (Cin) being 60%.

Operations

Next, the operations according to the exemplary embodiment are described.

As described above, in the protection mode, as shown in FIG. 7, with the transparent toner image TVG being superimposed upon the gold toner image TWG on the recording medium P before the fixing operation, the fixing device 40 performs the fixing operation.

As shown in FIG. 8, when the colored toner image TRG is superimposed upon the gold toner image TWG on the recording medium P before the fixing operation, the fixing device 40 performs the fixing operation with the transparent toner image TVG being superimposed upon the region EW of the gold toner image TWG upon which the colored toner image TRG is not superimposed.

Here, a comparative example in which the protection mode is not used (that is, when the transparent toner image TVG is not superimposed upon the gold toner image TWG) is described.

The gold toner TW from which the gold toner image TWG is formed contains the flat metallic pigments 110 whose principal component is a metal (aluminum in the exemplary embodiment). When the fixing device 40 performs the fixing operation, the metallic pigments 110, for example, get stuck on the fixing belt 411, and scratch the fixing belt 411. When images including gold toner images are to be printed on a large number of sheets, the occurrence of scratches is increased, as a result of which image quality is reduced (for example, uneven glossiness (variations in the FI value) of the images occurs, as a result of which the metallic glossiness (FI value) of the images is reduced).

Therefore, in the protection mode according to the exemplary embodiment, by superimposing the transparent toner image TVG upon the gold toner image TWG and fixing them to the recording medium P, the transparent toner image TVG is provided between the gold toner image TWG and the fixing belt 411. Therefore, compared to the comparative example in which the transparent toner image TVG is not superimposed upon the gold toner image TWG (that is, the entire gold toner image TWG is exposed), the gold toner TW (the metallic pigments 110) does not contact the fixing belt 411 or the number of times the gold toner TW contacts the fixing belt 411 is reduced during the fixing operation. Therefore, the occurrence of scratches on the fixing belt 411 is reduced, as a result of which a reduction in the metallic glossiness (FI value) of the images is reduced.

As shown in FIG. 7, in the protection mode according to the exemplary embodiment, the entire gold toner image TWG is covered by the transparent toner image TVG. Therefore, compared to the case in which part of the gold toner image TWG is exposed, contact of the gold toner TW (the metallic pigments 110) with the fixing belt 411 is reduced.

As shown in FIG. 8, at a region of the gold toner image TWG upon which the colored toner image TRG is superimposed, contact of the gold toner TW (the metallic pigments 110) with the fixing belt 411 is reduced by the colored toner image TRG. Therefore, when the colored toner image TRG is superimposed upon part of the gold toner image TWG, control is performed such that the transparent toner image TVG is superimposed only upon the region EW of the gold toner image TWG upon which the colored toner image TRG is not superimposed. Therefore, in the protection mode, the amount of consumption of the transparent toner TV is reduced.

Transparent Toner Image in Protection Mode

Figure 9:
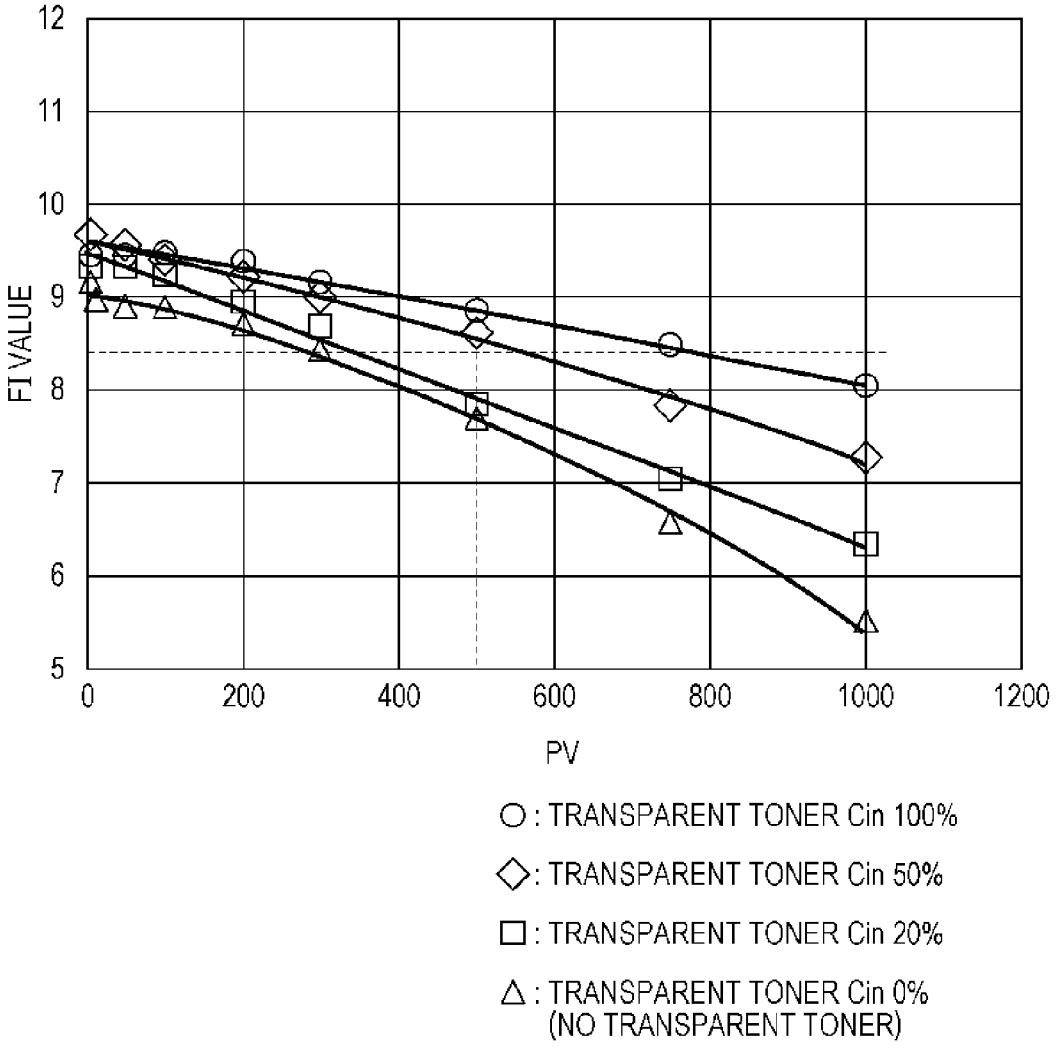
FIG. 9 shows a graph showing the relationship between dot area ratio (Cin) of the transparent toner image that is superimposed upon the gold toner image, the number of print pages (PV), and FI value.

FIG. 9 shows a graph showing the relationship between the dot area ratio (Cin) of the transparent toner image TVG that is superimposed upon the gold toner image TWG, the number of print pages (PV), and the FI value. The dot area ratio (Cin) of the transparent toner image TVG is 0% when the transparent toner image TVG is not superimposed upon the gold toner image TWG (the above-described comparative example).

In an experimental example, the gold toner image TWG is formed on the entire surface of an A4-size recording medium P with a dot area ratio of 60%, and the resulting image formed by superimposing the transparent toner image TVG upon the gold toner image TWG is continuously printed.

The graph in FIG. 9 shows that the FI value becomes smaller as the number of print sheets (PV) is increased, whereas a reduction in the FI value is reduced as the dot area ratio (Cin) of the transparent toner image TVG is increased.

For example, if the number of print pages is 1000, when the dot area ratio (Cin) of the transparent toner image TVG is 0% (that is, when the transparent toner image TVG does not exist), the FI value drops to approximately 5.5. However, when the dot area ratio (Cin) of the transparent toner image TVG is 20%, the FI value is approximately 6.3%; when the dot area ratio (Cin) of the transparent toner image TVG is 50%, the FI value is approximately 7.2; and, when the dot area ratio (Cin) of the transparent toner image TVG is 100%, the FI value is approximately 8.0.

In terms of the desired performance according to the exemplary embodiment, if the number of print pages is 500, the FI value is greater than or equal to 8.5. Therefore, if the dot area ratio (Cin) is greater than or equal to 50%, the desired performance is achieved. Consequently, in the exemplary embodiment, when the protection mode is set, the lower limit of the dot area ratio (Cin) of the transparent toner image TVG is 50%. Since, in the exemplary embodiment, the dot area ratio (Cin) of the transparent toner image TVG is set at 100%, if the number of print pages is 500, the FI value is approximately 8.9, so that the aforementioned desired performance is achieved.

Gold Toner Image in Protection Mode

Figure 10:
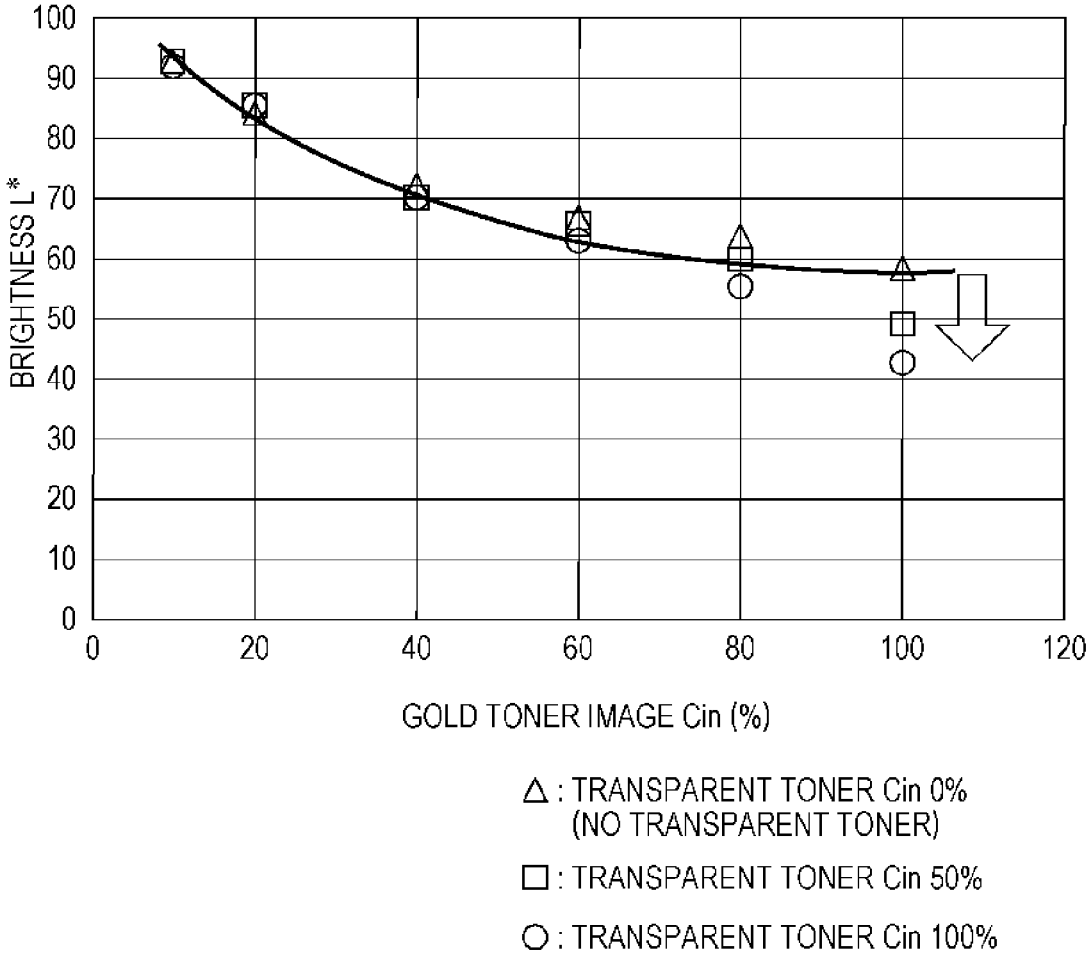
FIG. 10 shows a graph showing the relationship between dot area ratio (Cin) of the gold toner image upon which the transparent toner image has been superimposed after the fixing operation, the dot area ratio (Cin) of the transparent toner image, and brightness L*.

FIG. 10 shows a graph showing the relationship between the dot area ratio (Cin) of the gold toner image TWG upon which the transparent toner image TVG has been superimposed after a fixing operation, the dot area ratio (Cin) of the transparent toner image TVG, and brightness L*. The dot area ratio (Cin) of the transparent toner image TVG is 0% when the transparent toner image TVG is not superimposed upon the gold toner image TWG (the above-described comparative example).

FIG. 10 shows that, as the dot area ratio (Cin) of the gold toner image TWG is increased, the brightness L* is reduced. Further, if the dot area ratio (Cin) of the gold toner image TWG is greater than or equal to 60%, the higher the dot area ratio (Cin) of the transparent toner image TVG, the lower the brightness L*. That is, when the dot area ratio (Cin) of the transparent toner image TVG is increased, and the occurrence of scratches on the fixing belt 411 is reduced to reduce a reduction in the FI value, the brightness L* is reduced.

Therefore, in the exemplary embodiment, when the protection mode is set, the upper limit of the dot area ratio (Cin) of the gold toner image TWG is set such that the brightness L* becomes substantially greater than or equal to the brightness L* when the gold toner image TWG is not covered by the transparent toner image TVG. In the exemplary embodiment, when the protection mode is set, the upper limit of the dot area ratio (Cin) of the gold toner image TWG is set to 60%.

The major reasons why the brightness L* is reduced when the transparent toner image TVG is superimposed upon the gold toner image TWG are that the thickness is increased in correspondence with the thickness of the transparent toner image TVG, and, as shown in FIG. 5A, the directions in which the reflecting surfaces 110A of the flat metallic pigments 110 face tend to differ and an image surface tends to be uneven.

Others

The present invention is not limited to the above-described exemplary embodiment.

For example, in the above-described exemplary embodiment, as shown in FIGS. 7 and 8, the entire gold toner image TWG is covered by the transparent toner image TVG and the entire gold toner image TWG is covered by the transparent toner image TVG and the colored toner image TRG, respectively. However, part of the gold toner TW may be exposed.

Although, for example, in the above-described exemplary embodiment, the heating member that contacts and heats the toner images is the fixing belt 411, the heating member is not limited thereto. For example, the heating member may be a fixing roller.

For example, in the above-described exemplary embodiment, the upper limit of the dot area ratio (Cin) of the gold toner image TWG in the protection mode is set to 60%. However, this upper limit is merely an example, so that the upper limit is not limited thereto. The upper limit may be set, as appropriate, in accordance with, for example, the desired performance or product specification.

Although, in the exemplary embodiment, the protection mode is selectable, the invention is not limited thereto. When the gold toner image TWG is to be formed, control may be performed such that printing is automatically performed in the protection mode without selecting the protection mode.

In addition to the protection mode, the image forming apparatus 10 may have a cover mode in which the transparent toner image TVG is superimposed upon the entire image (both of the gold toner image TWG and the colored toner image TRG). Even in the cover mode, the upper limit of the dot area ratio (Cin) of the gold toner image TWG may be set, as appropriate, to 60% or in accordance with, for example, the desired performance or the product specification.

For example, in the above-described exemplary embodiment, the toner image forming unit 20V for the first special color (V) is disposed at the uppermost stream side in the direction of rotation of the intermediate transfer belt 31, and the toner image forming unit 20W for the second special color (W) is disposed at the lowermost stream side in the direction of rotation of the intermediate transfer belt 31. In other words, the toner image forming unit 20V for the first special color (V) first-transfers a toner image to the intermediate transfer belt 31 first, and, the toner image forming unit 20W for the second special color (W) first-transfers a toner image to the intermediate transfer belt 31 last.

However, the invention is not limited to such an arrangement and structure. The toner image forming unit 20W for the second special color (W) only needs to be disposed downstream from the toner image forming unit 20V for the first special color (V). In other words, any structure may be used as long as the toner image forming unit 20W transfers a toner image having the second special color (W) after the toner image forming unit 20V for the first special color (V) has first-transferred a toner image to the intermediate transfer belt 31.

In addition to being the intermediate transfer belt 31, for example, the intermediate transfer body may be one in which each colored toner image is first-transferred to the intermediate transfer drum, and is transferred to a recording medium from the intermediate transfer drum.

The image forming apparatus 10 may be a so-called rotary-development image forming apparatus. More specifically, the image forming apparatus 10 may be one that includes a rotary-development unit including multiple developing units for corresponding color components arranged along a circumference, and that, by rotating the rotary-development unit, successively switches between the developing units, and develops images by using toners having colors corresponding to the colors for which the photoconductors are provided. Then, the toner images formed on the corresponding photoconductors are successively transferred to the intermediate transfer body. After a final toner image has been formed on the intermediate transfer body, the final toner image is transferred from the intermediate transfer body to a recording medium P all at once, to form the image on the recording medium.

Alternatively, the image forming apparatus 10 may be one in which the colored toner images are successively transferred directly from the corresponding toner image forming units to the recording medium P without using the intermediate transfer body. In this case, after the toner image forming unit 20W for the second special color (W) of the gold toner TW has transferred the gold toner image TWG to the recording medium P, it is the turn of the transparent toner image TVG to be transferred to the recording medium P from the toner image forming unit 20V for the first special color (V) of the transparent toner TV.

The image forming apparatus may have various other structures in addition to the structure according to the above-described exemplary embodiment. Further, the present invention may be carried out in various modes within the scope that does not depart from the gist of the present invention.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a first image forming unit that forms a transparent toner image by using a transparent toner;

a second image forming unit that forms a metal-colored toner image by using a metal-colored toner containing a flat metallic pigment;

a fixing device that fixes a toner image to a recording medium as a result of a heating member contacting and heating the toner image; and a controller that controls the first image forming unit, the second image forming unit, and the fixing device, wherein, in a protection mode, the controller controls the first image forming apparatus and the second image forming apparatus to protect the heating member by superimposing the transparent toner image upon the metal-colored toner image and, in a non-protection mode, the controller controls the first image forming apparatus and the second image forming apparatus to form the metal-colored toner image without superimposing the transparent toner image upon the metal-colored toner image, and the controller controls the fixing device to fix the toner images.

2. The image forming apparatus according to claim 1, further comprising a third image forming unit that forms a colored toner image by using a colored toner, wherein, in the protection mode, the transparent toner image is superimposed upon a region of the metal-colored toner image upon which the colored toner image is not superimposed, and the toner images are fixed by the fixing device.

3. The image forming apparatus according to claim 2, wherein, in the protection mode, an upper limit is set for a dot area ratio of the metal-colored toner image upon which the transparent toner image is superimposed.

4. The image forming apparatus according to claim 3, wherein, in the protection mode, the dot area ratio of the transparent toner image that is superimposed upon the metal-colored toner image is 50% or greater.

5. The image forming apparatus according to claim 4, wherein, in the protection mode, the transparent toner image is formed such that an area of the transparent toner image is larger than an area of the metal-colored toner image.

6. The image forming apparatus according to claim 3, wherein, in the protection mode, the transparent toner image is formed such that an area of the transparent toner image is larger than an area of the metal-colored toner image.

7. The image forming apparatus according to claim 2, wherein, in the protection mode, a dot area ratio of the transparent toner image that is superimposed upon the metal-colored toner image is 50% or greater.

8. The image forming apparatus according to claim 7, wherein, in the protection mode, the transparent toner image is formed such that an area of the transparent toner image is larger than an area of the metal-colored toner image.

9. The image forming apparatus according to claim 2, wherein, in the protection mode, the transparent toner image is formed such that an area of the transparent toner image is larger than an area of the metal-colored toner image.

10. The image forming apparatus according to claim 1, wherein, in the protection mode, an upper limit is set for a dot area ratio of the metal-colored toner image upon which the transparent toner image is superimposed.

11. The image forming apparatus according to claim 10, wherein, in the protection mode, the dot area ratio of the transparent toner image that is superimposed upon the metal-colored toner image is 50% or greater.

12. The image forming apparatus according to claim 11, wherein, in the protection mode, the transparent toner image is formed such that an area of the transparent toner image is larger than an area of the metal-colored toner image.

13. The image forming apparatus according to claim 10, wherein, in the protection mode, the transparent toner image is formed such that an area of the transparent toner image is larger than an area of the metal-colored toner image.

14. The image forming apparatus according to claim 1, wherein, in the protection mode, a dot area ratio of the transparent toner image that is superimposed upon the metal-colored toner image is 50% or greater.

15. The image forming apparatus according to claim 14, wherein, in the protection mode, the transparent toner image is formed such that an area of the transparent toner image is larger than an area of the metal-colored toner image.

16. The image forming apparatus according to claim 1, wherein, in the protection mode, the transparent toner image is formed such that an area of the transparent toner image is larger than an area of the metal-colored toner image.

17. The image forming apparatus according to claim 1, wherein a mode of the image forming apparatus is set to the protection mode or the non-protection mode by the user.

18. The image forming apparatus according to claim 1, further comprising a third image forming unit that forms a colored toner image by using a colored toner, wherein, in the protection mode, when the controller controls the third image forming unit to superimpose the colored toner image upon a portion of the metal-colored toner image, the controller controls the first image forming unit to superimpose the transparent toner image only upon a region of the metal-colored toner image upon which the colored toner image is not superimposed, and the controller controls the fixing device to fix the toner images.

19. The image forming apparatus according to claim 1, wherein the controller controls the image forming apparatus in the protection mode or the non-protection mode based on a number of sheets to be printed with the metal-colored toner.

20. The image forming apparatus according to claim 1, wherein, in the protection mode, a dot area ratio of the transparent toner image that is superimposed on the metal-colored toner image has a lower limit.

21. An image forming apparatus comprising:

a first image forming unit that forms a transparent toner image by using a transparent toner;

a second image forming unit that forms a metal-colored toner image by using a metal-colored toner containing a flat metallic pigment;

a fixing device that fixes a toner image to a recording medium as a result of a heating member contacting and heating the toner image; and means for reducing an occurrence of scratches to the heating member when images including the metal-colored toner images are printed.

* * * * *